US006755490B2

(12) United States Patent
Welch et al.

(10) Patent No.: US 6,755,490 B2
(45) Date of Patent: Jun. 29, 2004

(54) DISHWASHER WITH ADJUSTABLE RACK

(75) Inventors: Rodney M. Welch, Jackson, TN (US); Robin K. Phifer, Jackson, TN (US); Wayne M. VanLandingham, Jackson, TN (US); Tiffany H. Shellabarger, Brownsville, TN (US)

(73) Assignee: Maytag Corporation, Newton, IA (US)

( * ) Notice: Subject to any disclaimer, the term of this patent is extended or adjusted under 35 U.S.C. 154(b) by 189 days.

(21) Appl. No.: 09/943,523

(22) Filed: Aug. 30, 2001

(65) Prior Publication Data

US 2003/0042825 A1 Mar. 6, 2003

(51) Int. Cl.[7] ..... A47B 81/00

(52) U.S. Cl. ..... 312/228.1; 312/311; 312/334.4; 74/500.5; 74/505; 74/506

(58) Field of Search ..... 312/228.1, 306, 312/311, 312, 334.4, 351; 108/144.11, 147, 106; 248/422, 295.11; 211/41.8; 74/500.5, 501.5 R, 504, 505, 506, 507, 508; 134/201, 56 D, 57 D, 58 D

(56) References Cited

U.S. PATENT DOCUMENTS

| | | | | | |
|---|---|---|---|---|---|
| 2,739,864 | A | * | 3/1956 | Saunders | 312/334.4 |
| 3,113,818 | A | * | 12/1963 | Armentrout et al. | 312/334.4 |
| 3,472,573 | A | | 10/1969 | Geiger | |
| 3,726,580 | A | | 4/1973 | Guth | |
| 3,736,037 | A | | 5/1973 | Doepke | |
| 3,761,153 | A | * | 9/1973 | Guth | 312/311 |
| 3,768,883 | A | | 10/1973 | Kauffman | |
| 3,809,450 | A | | 5/1974 | Guth | |
| 3,822,085 | A | * | 7/1974 | Clark | 312/311 |
| 3,851,943 | A | * | 12/1974 | Afful | 312/228.1 |
| 3,892,453 | A | | 7/1975 | Daily | |
| 4,064,887 | A | * | 12/1977 | Geiger et al. | 211/41.8 |
| 4,097,099 | A | | 6/1978 | Spiegel | |
| 4,291,929 | A | * | 9/1981 | Faust | 312/334.4 |
| 5,409,309 | A | | 4/1995 | Giddings et al. | |
| 5,474,378 | A | | 12/1995 | Smith et al. | |
| 5,595,200 | A | | 1/1997 | Favaro | |
| 5,657,878 | A | | 8/1997 | Austin | |
| 5,860,716 | A | | 1/1999 | Good et al. | |
| 5,896,703 | A | * | 4/1999 | Wright et al. | 74/506 |
| 5,941,339 | A | * | 8/1999 | Shimizu et al. | 74/500.5 |
| 6,112,462 | A | * | 9/2000 | Kolar | 74/500.5 |

FOREIGN PATENT DOCUMENTS

| | | | |
|---|---|---|---|
| EP | 0033483 | * | 8/1981 |
| EP | 1161917 | * | 12/2001 |
| EP | 1166708 | * | 1/2002 |

* cited by examiner

*Primary Examiner*—Lanna Mai
*Assistant Examiner*—Hanh V. Tran
(74) *Attorney, Agent, or Firm*—McKee, Voorhees & Sease, P.L.C.

(57) ABSTRACT

A dishwasher is provided with an adjustable rack that can be moved upwardly and downwardly within the washing chamber to accommodate different sized objects to be washed. The lift mechanism for the rack is housed within the sidewalls of the dishwasher. The lift mechanism employs a cable system to raise both sides of the rack simultaneously, with the rack positioned within or outside the washing chamber and with the rack either loaded or unloaded. In one embodiment, the lift mechanism is manually actuated by turning a handle. In another embodiment, the lift mechanism includes an electric motor with a switch on the control panel for raising and lowering the rack.

28 Claims, 7 Drawing Sheets

DISHWASHER WITH ADJUSTABLE RACK

BACKGROUND OF THE INVENTION

FIELD OF THE INVENTION

Dishwashers with adjustable racks are known in the art. Typically, such adjustable racks must be empty and moved out of the washing chamber to permit the height of the rack to be adjusted. Also, the lift mechanism for adjusting the height of the rack normally occupies space within the rack, thereby decreasing the area of the rack which can be used for placing dishes, glasses, and other objects to be washed. Also, such adjustable racks normally raise or lower one side of the rack and then the other side of the rack in sequential steps.

Accordingly, a primary objective of the present invention is the provision of a dishwasher having an improved adjustable rack.

Another objective of the present invention is the provision of an adjustable rack for a dishwasher which can be raised and lowered when positioned in or out of the washing chamber.

Another objective of the present invention is the provision of an adjustable rack for a dishwasher which can be raised and lowered when unloaded or loaded with objects to be washed.

A further objective of the present invention is the provision of a dishwasher having an adjustable rack wherein the lift mechanism is housed within the sidewalls of the dishwasher.

Still another objective of the present invention is the provision of a dishwasher having an adjustable rack wherein the lift mechanism does not occupy space within the rack.

A further objective of the present invention is the provision of an adjustable rack for a dishwasher wherein both sides of the rack are raised or lowered simultaneously.

Another objective of the present invention is the provision of a dishwasher having a rack wherein the height of the rack within the washing chamber can be manually adjusted.

Still another objective of the present invention is the provision of a dishwasher having a rack wherein the height of the rack within the washing chamber can be adjusted via a switch or button on the control panel of the dishwasher.

A further objective of the present invention is the provision of a dishwasher having an adjustable rack which is economical to manufacture and durable and efficient in use.

These and other objectives will become apparent from the following description of the invention.

SUMMARY OF THE INVENTION

The dishwasher of the present invention includes a washing chamber defined by opposite sidewalls, a top wall, a bottom wall, and a back wall. One or more racks are provided within the chamber for holding objects to be washed. The racks can be moved horizontally into and out of the washing chamber for loading and unloading the objects to be washed.

One or more of the racks is vertically adjustable to accommodate different sized objects to be washed. A lift mechanism is provided in the opposite sidewalls of the dishwasher and is operatively connected to the adjustable rack for raising and lowering the rack. The lift mechanism includes guide tracks extending vertically in the opposite sidewalls, and guide blocks movably mounted within the guide tracks. The guide blocks are interconnected by cables such that the opposite sides of the rack are raised or lowered simultaneously. The cables are connected to a drum gear which is rotated by a worm gear. In one embodiment, the worm gear is mounted on a shaft with a handle for manually turning the worm gear to raise and lower the rack. In another embodiment, an electric motor is connected to the worm gear and to a switch on the control panel for raising and lowering the rack.

DETAILED DESCRIPTION OF THE PREFERRED EMBODIMENT

Figure 1:
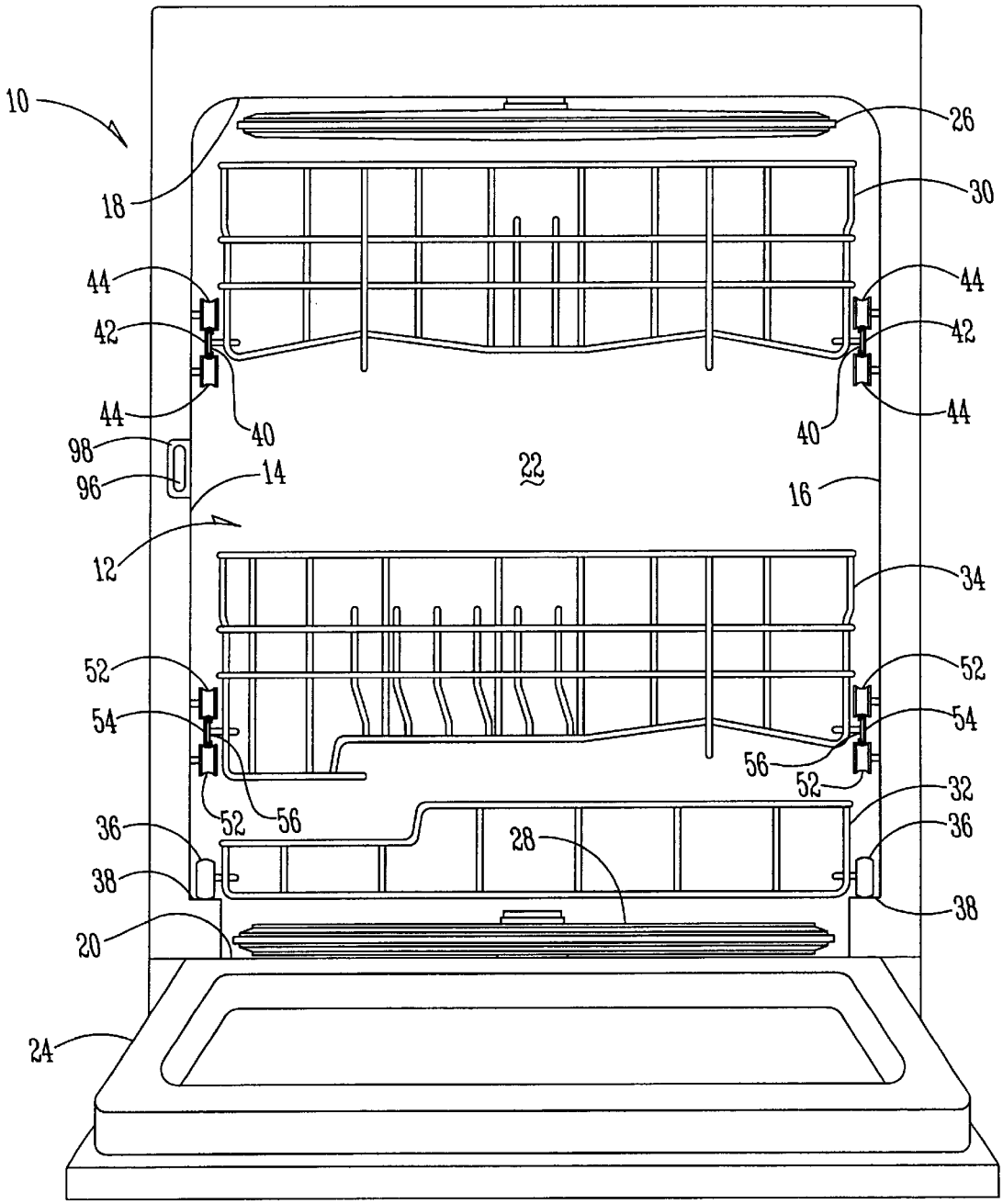
FIG. 1 is a front view of the dishwasher with the door open and the middle adjustable rack in a lower position.
Figure 2:
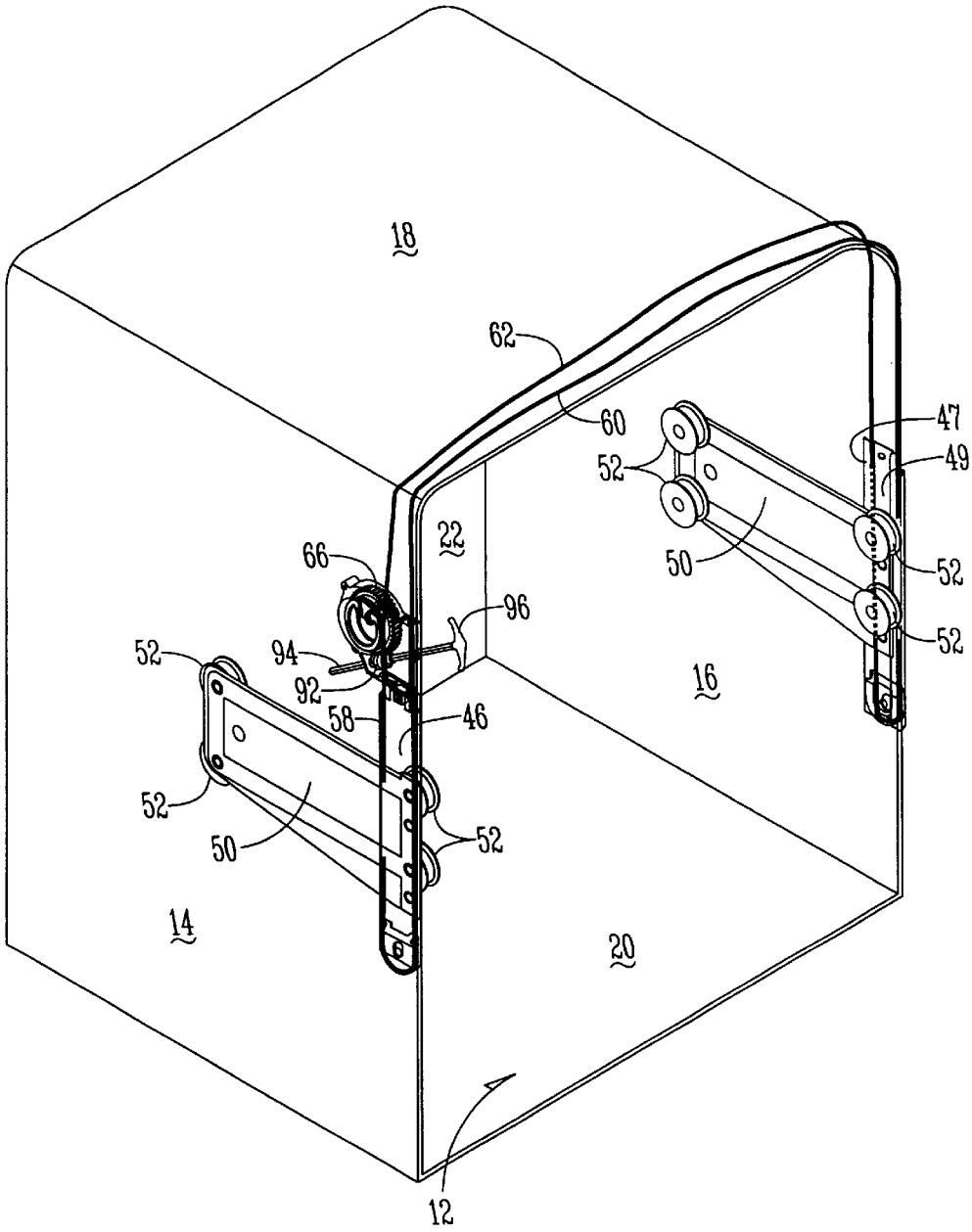
FIG. 2 is a schematic perspective view of the lift mechanism for the adjustable rack of the present invention.
Figure 3:
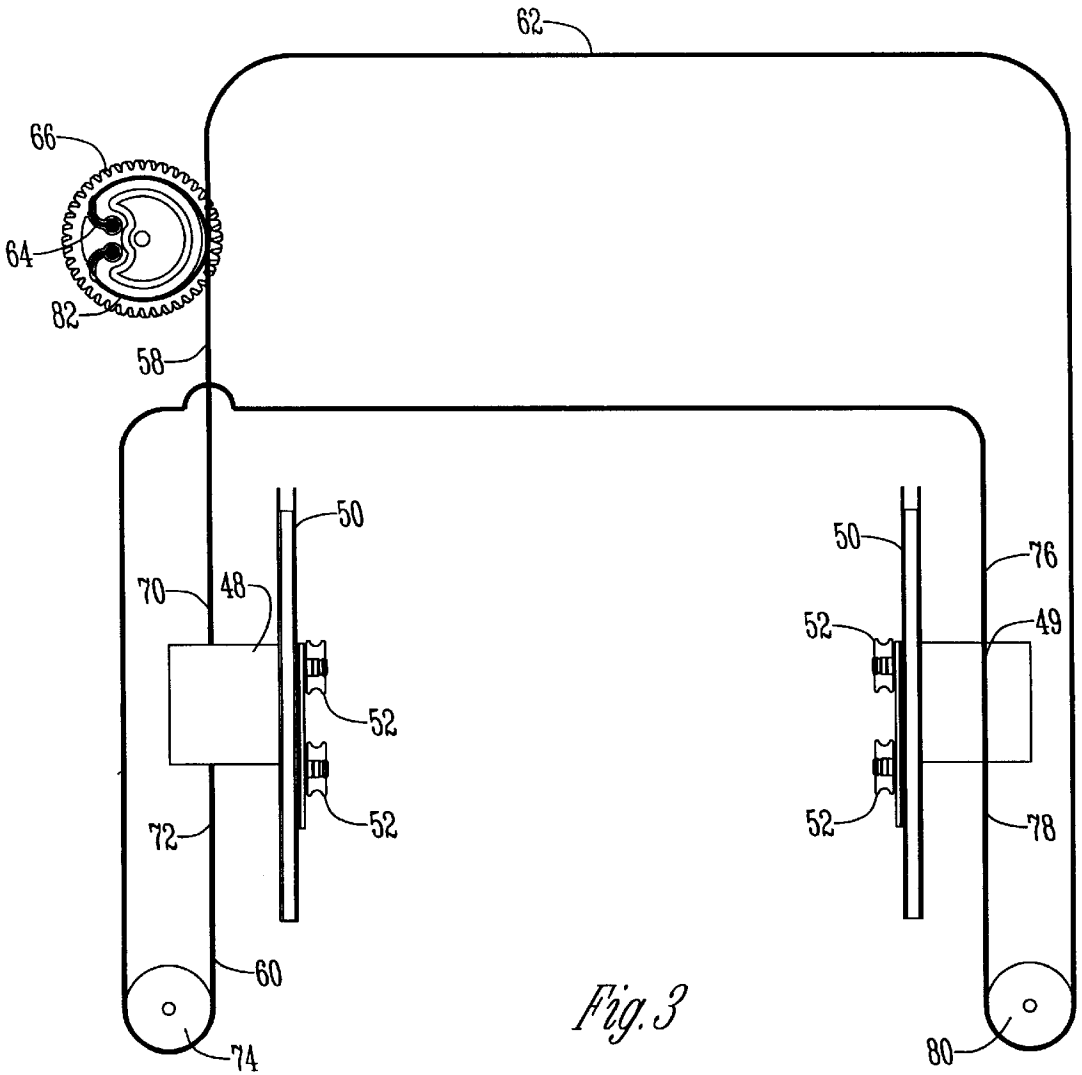
FIG. 3 is a front schematic view of the lift mechanism.

In the drawings, the reference numeral 10 generally designates a dishwasher. The dishwasher 10 includes a washing chamber 12 defined by opposite sidewalls 14, 16, a top wall 18, a bottom wall 20, and a rear wall 22. A door 24 is pivotally mounted to the dishwasher 10 for movement between open and closed positions. The dishwasher 10 includes upper and lower spray arms 26, 28.

As seen in FIG. 1, the dishwasher 10 includes an upper rack 30, a lower rack 32, and a middle rack 34. It is understood that one of the racks can be eliminated such that the dishwasher only has two racks. Each of the racks 30, 32 and 34 are moveable in a horizontal plane between a position within the washing chamber 12 and a position substantially outside the washing chamber 12 for loading and unloading objects to be washed. The lower rack 32 includes wheels 36 which ride along a ledge or lip 38 adjacent the opposite sidewalls 14, 16 of the dishwasher 10. The upper rack 30 includes rollers 40 which roll along guide rails 42, which in turn can be horizontally moved between upper and lower guide rollers 44 mounted on each of the sidewalls 14, 16.

The above structure of the dishwasher 10 is conventional and does not constitute a part of the present invention.

The present invention is directed towards the vertical adjustability of one of the racks. In the drawings and in the following description, the middle rack 34 is designated as the adjustable rack, though it is understood that the lift mechanism for adjusting the height of one of the racks can be utilized on any of the racks within the dishwasher 10.

The lift mechanism for raising and lowering the middle rack 34 is best seen in FIGS. 2–5 of the drawings. Generally, the lift mechanism is a cable system with an actuator for raising and lowering the middle rack 34 within the washing chamber 12. The lift mechanism is housed within the sidewalls 14, 16 of the dishwasher 10, and thus does not take up space within the rack 34.

More particularly, each sidewall 14, 16 has a C-shaped guide track 46, 47 mounted therein, respectively. Slidably mounted within each guide track 46, 47 is a guide block 48, 49, respectively, which are movable upwardly and downwardly within the guide tracks 46, 47. An arm 50 is fixed to and cantilevered from each guide block 48, 49. The arms reside within the washing chamber 12 adjacent the opposite sidewalls 14, 16. Each arm 50 includes four rollers 52 which receive guide rails 54. The rack 34 includes rollers 56 rollably mounted within the guide rails 54. Accordingly, the rollers 56 can roll horizontally through the guide rails 54, which in turn can roll along the rollers 52 such that the middle rack 34 can be moved into and out of the washing chamber 12.

The lift mechanism includes a set of cables 58, 60, 62. The first cable 58 has a first end 64 secured to a drum gear 66 rotatably mounted within the left sidewall 14. The cable 58 wraps around the drum gear 56 in a first circumferential groove 68, and has a second end 70 secured to the top of the guide block 48. The second cable 60 has a first end 72 secured to the bottom of the guide block 48. The cable 60 extends downwardly around a pulley 74 mounted at the lower end of the guide track 46 in the sidewall 14, and then upwardly over the top wall 18. The second end 76 of the cable 60 is secured to the top of the guide block 49. The third cable 62 has a first end 78 attached to the guide block 49. The cable 62 extends downwardly around a pulley 80 rotatably mounted in the guide track 47 in the sidewall 16, and then upwardly over the top wall 18. The opposite end 82 of the cable 62 extends around the drum gear 66 in a second groove 84 thereof and is secured to the drum gear 66. The cables 58, 62 extend around the gear drum 66 in opposite directions, such that upon rotation of the drum gear 66, one cable is wound onto the drum gear 66 and the other cable is unwound from the drum gear 66.

Figure 4:
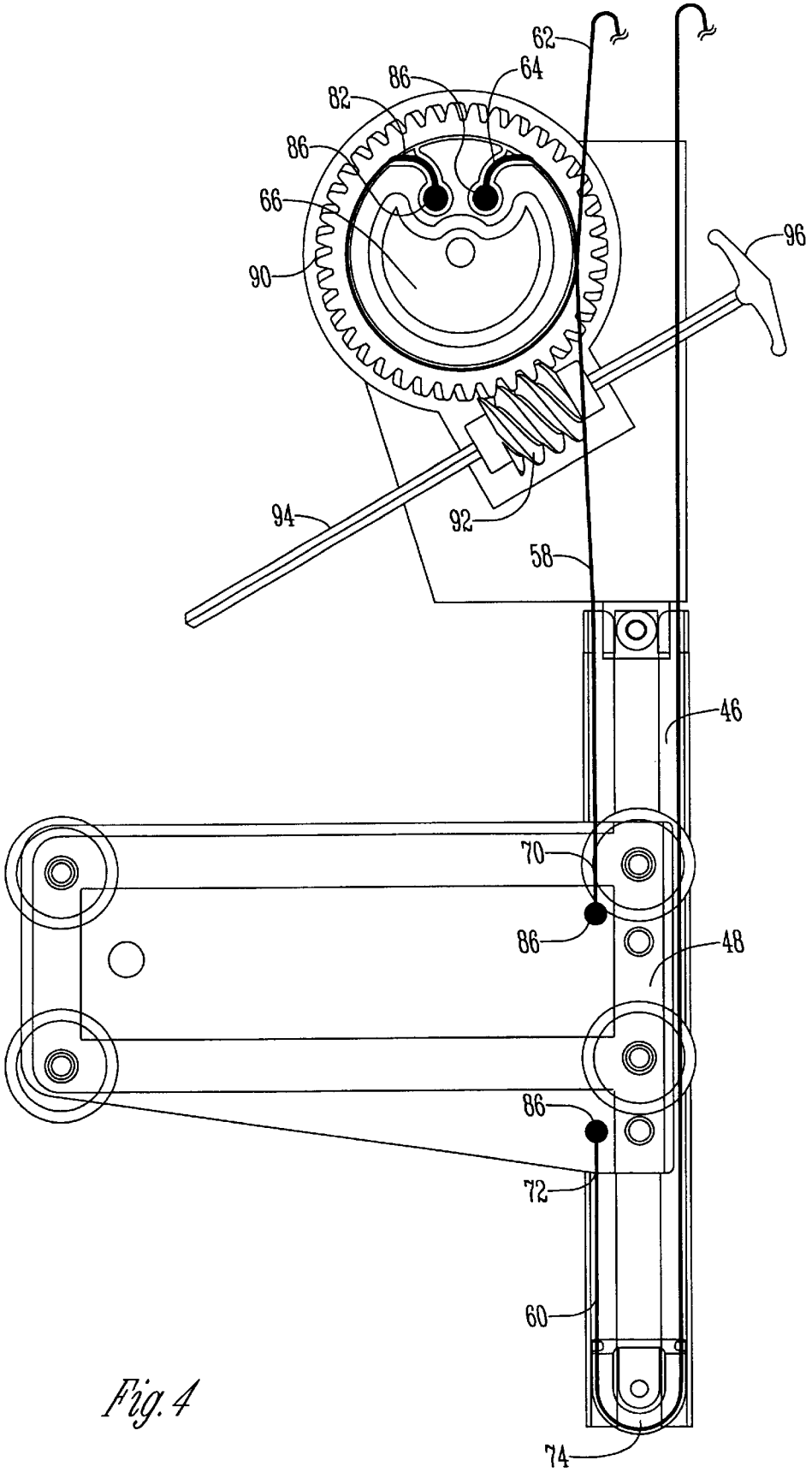
FIG. 4 is a side elevation view of the left-hand portion of the lift mechanism.
Figure 5:
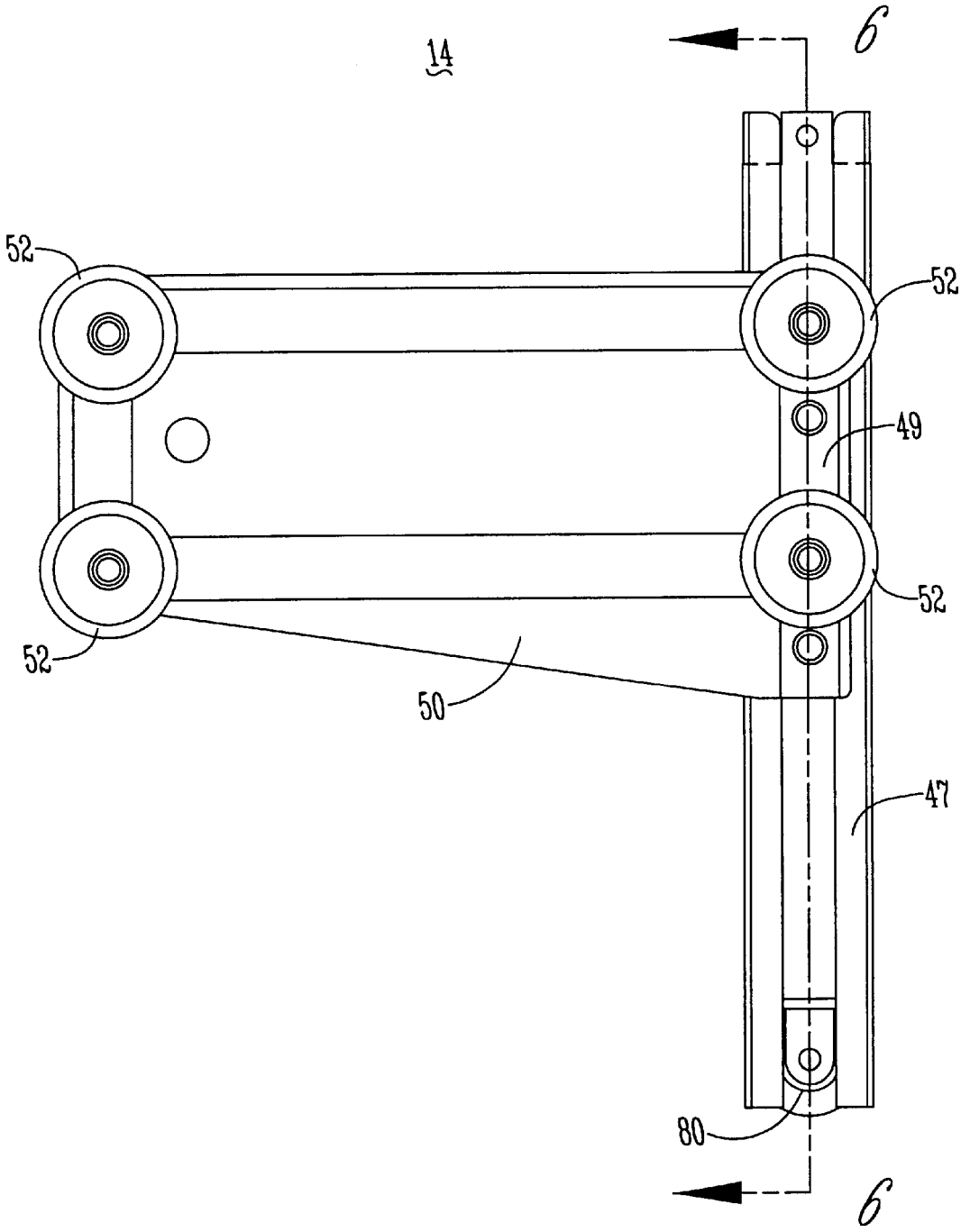
FIG. 5 is a side elevation view of the right hand portion of the lift mechanism.
Figure 6:
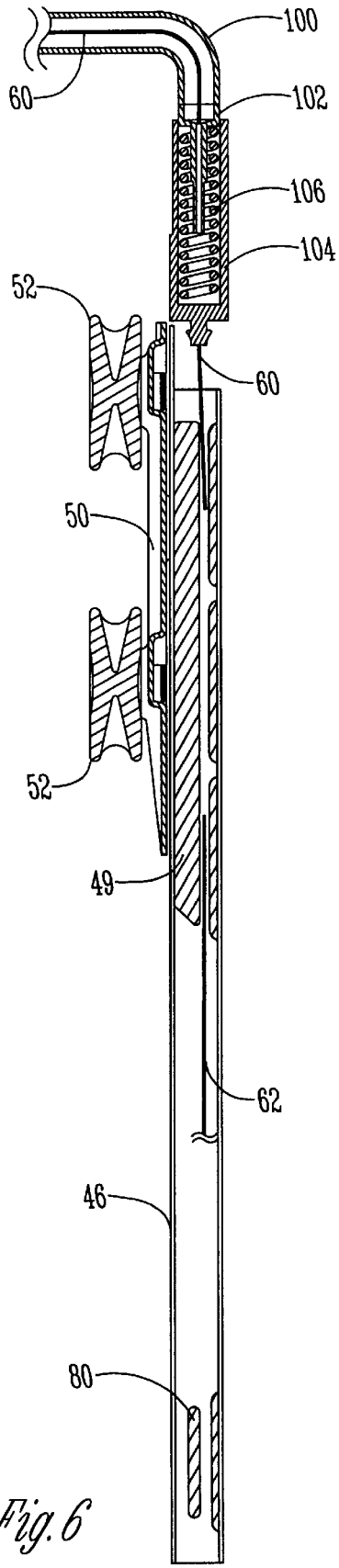
FIG. 6 is a sectional view taken along lines 6—6 of FIG. 5.
Figure 7:
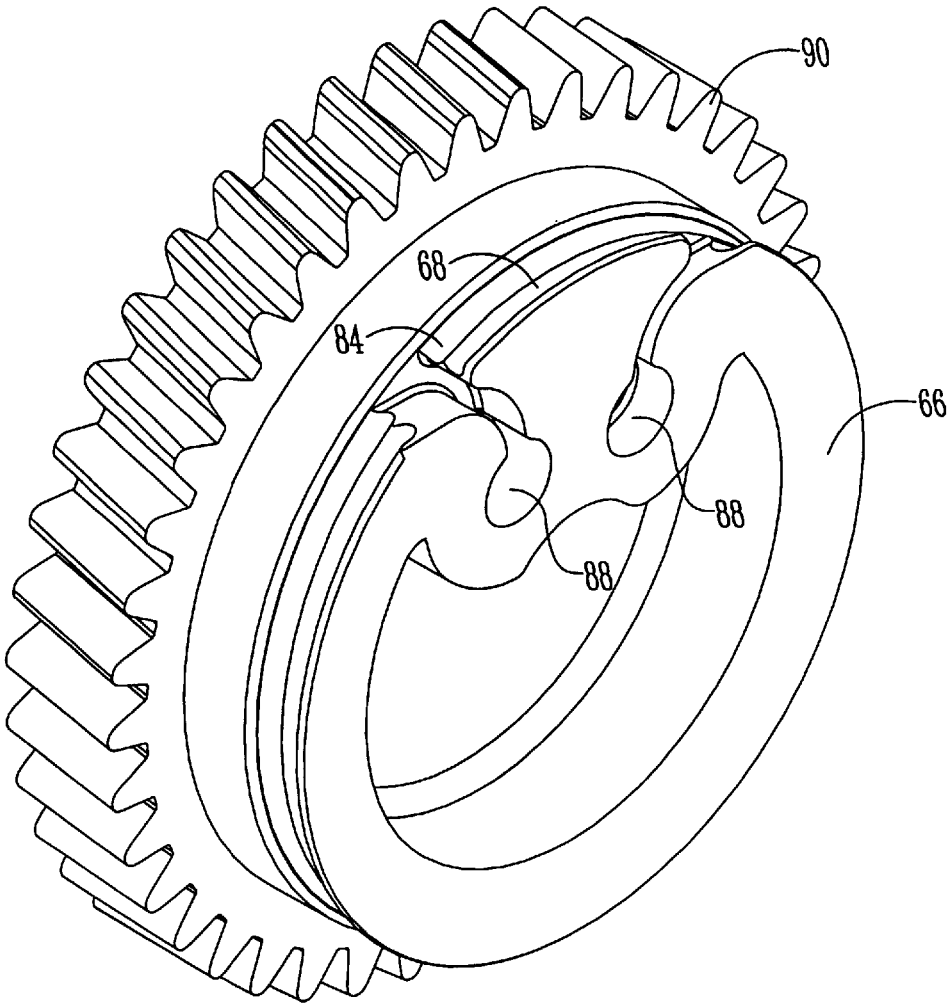
FIG. 7 is a perspective view of the drum gear.

The ends of the cables 58, 60, 62 can be attached in any convenient manner to the drum gear 66 and guide blocks 48, 49. For example, as best seen in FIG. 4, a nodule 86 is provided on the end 64 of the cable 58 and the end 82 of the cable 62 are adapted to be matingly received within cavities or recesses 88 in the drum gear 66. Similar cavities or recesses are provided in the guide blocks 48, 49 to receive the nodule 86 on the cable ends connected to the guide blocks 48, 49.

The drum gear 66 includes perimeter teeth 90 which mesh with a worm gear 92. The worm gear is mounted on a shaft 94 for rotation therewith. An actuation handle 96 is mounted on the forward end of the shaft 94 and is positioned adjacent the front opening of the washing chamber 12 for access when the door 24 is opened. Upon manual turning of the handle 96 in the clockwise position, the worm gear 92 rotates in a counterclockwise direction, as seen in FIG. 4, so as to further wrap the cable 58 around the drum gear 66 and to unwrap the cable 62 from the drum gear 66, thereby raising the guide blocks 48, 49 within the guide tracks 46, 47 so as to raise the middle rack 34 within the washing chamber 12. Turn the handle 96 in a counterclockwise direction rotates the drum gear 66 in a clockwise direction, thereby unwrapping the cable 58 from the drum gear 66 and wrapping the cable 62 further around the drum gear 66 so as to pull the guide blocks 48, 49 downwardly within the guide tracks 46, 47 thereby lowering the middle rack 34 within the washing chamber 12.

Preferably, the shaft 94 is square or hex-shaped and slidably extends through the worm gear 92. Thus, the handle 96 can be moved from a position next to the front opening of the washing chamber 12 such that the door 24 can be closed, and pulled outwardly a short distance away from the front opening of the washing chamber 12 when the door 24 is opened so as to provide easy turning of the handle 96 by a user. The sidewall 14 includes a recess 98 to house the handle 96 when in the retracted or inoperative position, as best seen in FIG. 1.

The cables 60, 62 extend through flexible conduits 100 extending over the top wall 18 of the dishwasher 10. The conduits 100 terminate at each end in a bushing 102 which is slidably mounted within a channel insert 104 adjacent the top of the guide tracks 46, 47. A spring 106 is provided within the channel insert 104. As the cables 60, 62 are pulled downwardly through the channel insert 104, the spring 106 compresses to provide feedback to the user as the guide blocks 48, 49 reach the end of their travel within the guide tracks 46, 47 of, if the dishes start to compress or contact the underside of upper rack 30. Thus, the user knows when to stop turning the handle 96.

In an alternative embodiment, the cable 62 can be eliminated, with the lowering of the rack 32 occurring by gravity when the handle 96 is turned in a counterclockwise direction.

As a further alternative, a small electric motor (not shown) can be operatively connected to the drum gear 66, with a control switch provided on the control panel of the dishwasher 10. Thus, the lift mechanism can be quickly and easily actuated via the switch.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A dishwasher comprising:

opposite left and right sidewalls, a top wall, a bottom wall, and a rear wall defining a washing chamber;

a rack for holding objects to be washed and being horizontally movable between a first position within the chamber and a second position substantially out of the chamber;

a lift mechanism mounted within the opposite sidewalls and connected to the rack, and including a cable system so as to raise and lower the rack; and an actuator for controlling operation of the lift mechanism wherein the lift mechanism includes left and right guide tracks extending vertically in the left and right sidewalls, respectively, left and right guide blocks movably mounted in the left and right guide tracks, respectively, and the cable system interconnects the guide blocks for simultaneous movement of the blocks in the tracks.

2. The dishwasher of claim 1 wherein the actuator includes a drum gear about which the cable system is wrapped, and a handle for turning the drum gear in a first direction to raise the rack and in a second direction to lower the rack.

3. The dishwasher of claim 2 wherein the drum gear includes teeth and the handle includes a shaft slidably extending through a worm gear in mesh with the teeth of the drum gear.

4. The dishwasher of claim 1 wherein the cable system includes first and second cables extending between the actuator and the left and right guide blocks, respectively.

5. The dishwasher of claim 4 wherein the cable system further includes a third cable extending between the left and right guide blocks.

6. The dishwasher of claim 1 wherein the rack includes rollers for moving the rack out of the chamber for loading and unloading, the rollers being operatively connected to the guide blocks such that the rack can be raised when it is either in or out of the chamber.

7. The dishwasher of claim 1 wherein the rack includes rollers for moving the rack out of the chamber for loading and unloading, the rollers being operatively connected to the guide blocks such that the rack can be raised when it is being loaded or unloaded.

8. The dishwasher of claim 1 wherein the lift mechanism can be actuated by the actuator when the rack is either in or out of the chamber.

9. The dishwasher of claim 1 wherein the lift mechanism can be actuated by the actuator when the rack is either loaded or unloaded.

10. The dishwasher of claim 1 wherein the actuator is located adjacent one sidewall and moves both sides of the rack vertically.

11. A dishwasher comprising:

opposite left and right sidewalls, a top wall, a bottom wall, and a rear wall defining a washing chamber;

a rack for holding objects to be washed and being horizontally movable between a first position within the chamber and a second position substantially out of the chamber;

a lift mechanism connected to the rack, and including a cable system to simultaneously move both sides of the rack in a vertical direction; and an actuator for controlling operation of the lift mechanism wherein the lift mechanism includes left and right guide tracks extending vertically in the left and right sidewalls, respectively, left and right guide blocks movably mounted in the left and right guide tracks, respectively, and the cable system interconnects the guide blocks for simultaneous movement of the blocks in the guide tracks.

12. The dishwasher of claim 11 wherein the actuator includes a drum gear about which the cable system is wrapped, and a handle for turning the drum gear in a first direction to raise the rack and in a second direction to lower the rack.

13. The dishwasher of claim 12 wherein the drum gear includes teeth and the handle includes a shaft slidably extending through a worm gear in mesh with the teeth of the drum gear.

14. The dishwasher of claim 11 wherein the cable system includes first and second cables extending between the actuator and the left and right guide blocks, respectively.

15. The dishwasher of claim 14 wherein the cable system further includes a third cable extending between the left and right guide blocks.

16. The dishwasher of claim 11 wherein the rack includes rollers for moving the rack out of the chamber for loading and unloading, the rollers being operatively connected to the guide blocks such that the rack can be raised when it is either in or out of the chanter.

17. The dishwasher of claim 11 wherein the rack includes rollers for moving the rack out of the chamber for loading and unloading, the rollers being operatively connected to the guide blocks such that the rack can be raised when it is loaded or unloaded.

18. The dishwasher of claim 11 wherein the lift mechanism can be actuated by the actuator when the rack is in or out of the chamber.

19. The dishwasher of claim 11 wherein the lift mechanism can be actuated by the actuator when the rack is loaded or unloaded.

20. The dishwasher of claim 11 wherein the actuator is located adjacent one sidewall and moves both sides of the rack vertically.

21. A dishwasher comprising:

opposite left and right sidewalls, a top wall, a bottom wall, and a rear wall defining a washing chamber;

a rack for holding objects to be washed and being horizontally movable between a first position within the chamber and a second position substantially out of the chamber;

a lift mechanism mounted within the opposite sidewalls and connected to the rack, and including a cable system so as to raise and lower the rack;

an actuator for controlling operation of the lift mechanism; and the lift mechanism having left and right guide tracks extending vertically in the left and right sidewalls, respectively, left and right guide blocks movably mounted in the left and rigth guide tracks, respectively, and the cable system interconnecting the guide blocks for simultaneous movement of the blocks in the tracks.

22. The dishwasher of claim 21 wherein the lift mechanism has left and right arms cantilevered from the left and fight guide blocks, respectively.

23. The dishwasher of claim 22 wherein the arms each include rollers operatively connected to the rack.

24. The dishwasher of claim 23 wherein the rollers have a first and second set of vertically spaced rollers.

25. The dishwasher of claim 21 wherein the actuator includes a drum gear about which the cable system is wrapped, and a handle for turning the drum gear in a first direction to raise the rack and in a second direction to lower the rack.

26. The dishwasher of claim 25 wherein the drum gear includes teeth arid the handle includes a shaft slidably extending through a worm gear in mesh with the teeth of drum gear.

27. The dishwasher of claim 22 wherein the cable system includes first and second cables extending between the actuator and the left and right guide blocks, respectively.

28. The dishwasher of claim 22 wherein the cable system further includes a third cable extending between the left and right guide blocks.

* * * * *